US006599953B1

(12) United States Patent
Ratke et al.

(10) Patent No.: US 6,599,953 B1
(45) Date of Patent: Jul. 29, 2003

(54) PRECISION CASTING AND DEAD-MOLD CASTING IN PLASTIC/CARBON AEROGELS

(75) Inventors: Lorenz Ratke, St. Augustin (DE); Jochen Fricke, Wurzburg (DE)

(73) Assignee: DLR Deutsches Zentrum fur Luft-und Raumfahrt e.V. (DE)

( * ) Notice: Subject to any disclaimer, the term of this patent is extended or adjusted under 35 U.S.C. 154(b) by 0 days.

(21) Appl. No.: 09/527,809

(22) Filed: Mar. 17, 2000

(30) Foreign Application Priority Data

Mar. 17, 1999 (DE) ..... 199 11 847

(51) Int. Cl.[7] ..... C08G 65/38
(52) U.S. Cl. ..... 521/180; 521/181; 521/186
(58) Field of Search ..... 521/180, 181, 521/186

(56) References Cited

U.S. PATENT DOCUMENTS 4,873,218 A 10/1989 Pekala
6,068,882 A * 5/2000 Ryu ..... 427/246
6,099,965 A * 8/2000 Tennent et al. ..... 264/29.1

FOREIGN PATENT DOCUMENTS

DE 19721600 11/1998
DE 19738466 12/1998

OTHER PUBLICATIONS

Tscheuschner, D. and Ratke, L., "Investment Casting in Silica Aerogels," *Materials Science Forum*, vol. 329–330, pp. 479–486 (2000).

Alkemper, J., Diefenbach, S., and Ratke, L., "Chill Casting into Aerogels," *Scripta Metallurgica et Materialia*, vol. 29, pp. 1495–1500 (1993).

Hrubesh, Lawrence W., "Aerogel Applications," *Journal of Non–Crystalline Solids*, 225:335–342 (1998).

Fricke, J. and Tillotson, T., "Aerogels: Production, Characterization, and Applications," *Thin Solid Films*, 297:212–223 (1997).

R. Petricevic, et al., "Structure of Carbon Aerogels Near the Gelation Limit of the Resorcinol–Formaldehyde Precursor," *Journal of Non–Crystalline Solids*, 255:41–45, (1998).

R.W. Pekala, et al., "Aerogels Derived from Multifunctional Organic Monomers," *Journal of Non–Crystalline Solids*, 145:90–98, (1992).

R.W. Pekala, et al., "Carbon Aerogels and Xerogels," *Materials Research Society Symposium Proceedings*, vol. 270 (1992).

Feinguβ für alle Industriebereiche, 2nd edition, Zentrale für Guβverwendung, Düsseldorf (1987).

Krekeler, K.A., "Feingiessen," in Speer, ed., *Handbuch der Fertigungstechnik*, Bd 1 (1981), pp. 409–422.

* cited by examiner

*Primary Examiner*—John M. Cooney, Jr.
(74) *Attorney, Agent, or Firm*—Hunton & Williams

(57) ABSTRACT

The present invention relates to a molding material for the precision casting and dead-mold casting of metals or metal alloys comprising plastic and/or carbon aerogels, and a process for the preparation of such molding materials.

The molding material comprises highly porous open-cell plastic and/or carbon aerogels, obtainable by the sol-gel polymerization of organic plastic materials, optionally followed by partial or complete pyrolysis of the plastic aerogel obtained.

5 Claims, No Drawings

PRECISION CASTING AND DEAD-MOLD CASTING IN PLASTIC/CARBON AEROGELS

The present invention relates to a molding material for the precision casting and dead-mold casting of metals or metal alloys comprising plastic and/or carbon aerogels, and a process for the preparation of such molding materials.

Precision casting in ceramic shell molds is a standard casting technique for preparing precision moldings from a wide variety of alloys. The molds are usually prepared by the lost-wax process, i.e., a wax molding of the part to be cast is wetted with a silica sol, sand-coated in several steps, dried, and then the shell mold is baked wherein the wax is melted and drained or burned in an autoclave. With modern casting processes, it is possible to achieve conformal casting with high fidelity (J. Sprunk, W. Blank, W. Grossmann, E. Hauschild, H. Rieksmeier, H. G. Rosselnbruch; Feinguβ für alle Industriebereiche, 2nd edition, Zentrale für Guβverwendung, Düsseldorf 1987; K. A. Krekeler, Feingieβen, in: Handbuch der Fertigungstechnik Bd. 1, editor: G. Speer, Hanser Verlag, München 1981).

Aerogels are highly porous open-cell oxidic solids which are usually obtained by sol-gel processes from metal alkoxides by polymerization, polycondensation to gels, followed by supercritical drying. For some years, it has also been possible to prepare plastic gels by a sol-gel process and to convert them to a highly porous organic solid by supercritical drying. Pyrolysis of such plastic aerogels under a protective gas or vacuum at temperatures above 1000° C. converted them to carbon aerogels. Like the oxidic aerogels, plastic and carbon aerogels have extremely low effective thermal conductivities (on the order of some mW/K/m), but they are significantly lighter than the oxidic aerogels. The physical and mechanical properties of plastic and carbon aerogels are documented in the literature (R. W. Pekala, C. T. Alviso, F. M. Kong, S. S. Hulsey; J. Non-Cryst. Solids 145 (1992) 90; R. W. Pekala, C. T. Alviso, Mat. Res. Soc. Symp. Proc. 270 (1992) 3; R. Petricevic, G. Reichenauer, V. Bock, A. Emmerling, J. Fricke; J. Non-Cryst. Solids (1998)). They can be varied within a wide range by appropriately selecting the starting materials, their mixing ratio and the preparation process.

Therefore, it has been the object of the present invention to simplify the prior art processes for the preparation of molding materials for the precision casting and dead-mold casting of metals and metal alloys, especially to reduce the time required for drying in the process.

In a first embodiment, the above object is achieved by a molding material for the precision casting and dead-mold casting of metals or metal alloys comprising highly porous open-cell plastic and/or carbon aerogels, obtainable by the sol-gel polymerization of organic plastic materials, optionally followed by partial or complete pyrolysis of the plastic aerogel obtained.

The molding material according to the invention is particularly suitable for use in lost-wax processes, eliminating the need for application in multiple steps, as with oxidic gels of the prior art.

According to conventional techniques, the molds thus obtained are filled with a melt, and the melt is solidified. In the usual casting techniques, the heat is dissipated through the shell mold or the molding sand. In contrast, since carbon aerogels are quasi-adiabatic, casting and solidification in aerogels means that the heat is dissipated solely through feeders and risers or through especially provided cooling means; conveniently, but not necessarily, the feeders and risers themselves may be used for this purpose. Thus, a completely controlled solidification is possible, and the assembly can be adjusted in accordance with the range of properties required.

The aerogel molds prepared according to the invention are especially suitable for casting aluminum alloys (the casting mold having to be heated virtually not at all, since there is no heat dissipation through the mold itself). This increases economic efficiency because energy costs can be lowered. Magnesium and titanium alloys do not react with carbon either; thus, the carbon aerogel molds are also a good selection as molding materials for these alloys under protective gas or vacuum.

One particular advantage of the molding materials according to the invention is that the sol-gel formation can be completed within a few hours at room temperature, i.e., in particular, at temperatures below the pour point of the wax. Supercritical drying, as with the purely inorganic gels, is not necessary. Nevertheless, it is possible to adjust the cell size in the micrometer range. In addition, when drying is performed in a supercritical range of temperatures, cell sizes in the nanometer range are also possible.

In addition, the molding materials according to the invention may also contain inorganic or organic filler materials. This essentially means stable materials which are inert under solidification conditions. For example, inorganic filler materials may be selected from alumina, titania and/or quartz each of which may be employed in a proportion of from 5 to 30% by volume. Fillers according to the present invention further include fibers, allowing a fiber reinforcement by organic, inorganic, carbon and/or SiC fibers in appropriately the same proportion.

Similarly, it is also possible to employ organic fillers, for example, thermoplastic or thermosetting plastic particles, such as polystyrene, or organic (such as polyacrylonitrile), inorganic (such as SiC) or carbon fibers. However, it has to be taken care that these materials are also removed by melting or burning off in the pyrolysis of the plastic gels. Using such materials, it is possible, however, to control the shrinkage during the pyrolysis.

It is particularly preferred according to the present invention to employ for the molding material resorcinol/formaldehyde-based plastic aerogels which, when having an appropriate composition and an appropriate content of basic catalyst, can be converted to a microstructured plastic aerogel at temperatures of between 20 and 50° C. without supercritical drying. By selecting the composition, the sol-gel polymerization can be adjusted in such a way, for example, that a highly viscous liquid is first formed which can be applied to a wax mold. This can also be done in several working cycles so that the layer thickness can be adapted to the requirements of the applications in casting.

Thus, another embodiment of the present invention is a process for the preparation of casting molds for the precision casting and dead-mold casting of metals or metal alloys using highly porous open-cell plastic and/or carbon aerogels, comprising the steps:

a) wetting a wax mold with a plastic sol of an appropriate composition containing an appropriate catalyst;

b) converting the sol to a gel at a temperature below the pour point of the wax;

b') optionally, applying one or more additional layers of the sol each of which is partially or completely converted to the gel form;

c) drying the gel at a temperature below the pour point of the wax; and d) melting and draining or burning off the wax from the solidified gel at a temperature above the pour point of the wax.

An alternative process for preparing the casting mold consists in:

a) placing a wax molding in a container;

b) filling the container partly or wholly with a plastic sol;

c) converting the sol to the gel form at a temperature below the pour point of the wax;

d) drying the gel at a temperature below the pour point of the wax; and e) melting and draining or burning off the wax from the solidified gel at a temperature above the pour point of the wax.

Thus, it is possible simply to place the wax molding in a suitable container, fill it with the starting solution for the plastic aerogels and then perform the process for preparing the aerogel.

In this way, solid, but light-weight quasi-adiabatic molds can be prepared by analogy with the known block mold process (which essentially uses gypsum).

The conversion temperature of the solution to a plastic aerogel must be adapted to the melting point of the wax. After conversion to a plastic aerogel, the wax can be removed by melting, and at the same time, with the exclusion of air, the conversion to a carbon aerogel can be effected. Depending on the composition of the starting solution, the gelling temperature and the density of the porous body formed, casting molds can be prepared both as a plastic and as a carbon aerogel which have a smooth finish on a micrometer scale and provide conformal molding. According to the invention, the preparation of molds up to the stage of the plastic aerogel usually takes from 1 to 3 days, often only up to 24 hours. The duration of pyrolysis is determined by the thickness of the casting shell mold; for example, a wall thickness of 1 cm requires a time of less than 24 hours, often less than 10 hours. As compared to the preparation of typical precision casting shell molds using oxidic sol-gel processes, the preparation times are short and thus economically efficient. In both process steps, shrinkage is always isotropic and may vary between a few percent and 20%. It can be reduced and influenced by selecting the composition of the sol, the drying conditions, the mold material and fillers, and thus is under control.

By way of example, the respective process steps for the preparation of plastic aerogel molds are characterized as follows:

a) Block mold method:

1. Preparation of the starting solution (resorcinol, formaldehyde, water and basic catalyst);
2. storage of the wax model in a PTFE or glass container;
3. filling the container in 2. with the starting solution (as the specific gravity of the wax models is generally lower than that of the solution, the mold must be correspondingly weighted (best at the risers and feeders));
4. gelling in a temperature-controlled water bath (in this case, the mold should be tightly sealed lest the solution should change its composition) or in a forced air oven in a temperature range of from 20 to 50° C.;
5. after the gelling is complete, the gel, while still wet, is dried at the same temperature in the closed mold to form the microstructured plastic aerogel;
6. placing the plastic aerogel block with the enclosed wax model in a pyrolysis oven which is sufficiently flushed with a protective gas. Heating to 1050° C. over a period of about 3 hours and maintaining this temperature for about 4 to 24 hours. The mold is placed in such a way that the wax can drain out.

b) Precision casting shell molds:

1. Identical with a) 1.;
2. identical with step a) 4. Gelling may be stopped in order to keep a highly viscous liquid;
3. immersing the wax molding into the partly gelled starting solution; and
4. final gelling and drying in a forced air oven at about 40° C.;
5. if steps 3. and 4. are repeated (without complete drying), layers of different thicknesses can be applied, followed by final drying and conversion to a plastic aerogel in the forced air oven;
6. identical with a) 6.

EXAMPLE

A solution of 110 g of resorcinol (Merck), 162 g of formaldehyde solution (37%, Merck), 0.075 g of $Na_2CO_3$ and 750 ml of water was stirred mechanically at room temperature.

A glass container in which a wax model (weighted with steel plates) of the molding was provided was filled with the solution until the model was completely covered. The container was sealed. Within two hours, the solution gelled within a forced air oven (Heraeus) at 40° C. The color of the clear solution was observed to turn ocher yellow/light brown. Drying of the gel was achieved in the forced air oven within 24 hours. Then, the wax was removed by melting at a temperature of 60° C.

In a further step, the plastic aerogel was placed in a cold muffle furnace. The furnace was slowly (3 hours) heated to 1050° C. with a constant flow of nitrogen (argon or another inert gas is also possible) for avoiding oxidation. The temperature of 1050° C. was maintained for 24 hours.

Subsequently, cooling was effected with a constant gas flow, and the carbon aerogel mold was removed.

What is claimed is:

1. A molding material for the precision casting and dead-mold casting of metals or metal alloys consisting essentially of:

a plastic aerogel obtained by sol-gel polymerization of an organic plastic material; and organic fibers or filler, wherein the molding material is highly porous having open cells and the organic fibers or filler are thermoplastic or thermosetting plastic particles.

2. The molding material according to claim 1, wherein the organic fibers or filler materials are present in an amount of 5% to 30% by volume.

3. The molding material according to claim 1, wherein the sol-gel polymerized plastic or carbon aerogel comprises a resorcinol and formaldehyde sol/gel and a basic polymerization catalyst.

4. The molding material according to claim 1, wherein the organic filler or fibers is polystyrene or polyacrylonitrile.

5. The molding material according to claim 3, wherein the basic polymerization catalyst is ammonia, sodium carbonate, or a combination thereof.

* * * * *